United States Patent [19]

Steenstrup

[11] 4,302,112

[45] Nov. 24, 1981

[54] PROCESS FOR CONTINUOUS HOMOGENIZATION OR EMULSIFICATION OF LIQUID AND AN ULTRASONIC APPARATUS FOR CARRYING OUT THE PROCESS

[75] Inventor: Per R. Steenstrup, Hellerup, Denmark

[73] Assignee: Reson System ApS, Hillerod, Denmark

[21] Appl. No.: 149,199

[22] PCT Filed: Jan. 17, 1979

[86] PCT No.: PCT/DK79/00001

§ 371 Date: Sep. 14, 1979

§ 102(e) Date: Sep. 14, 1979

[87] PCT Pub. No.: WO79/00525

PCT Pub. Date: Aug. 9, 1979

[51] Int. Cl.[3] ..... B01F 11/02; B01F 13/00

[52] U.S. Cl. ..... 366/114; 241/1; 366/127

[58] Field of Search ..... 366/111-115, 366/127; 241/1

[56] References Cited

U.S. PATENT DOCUMENTS

| | | | |
|---|---|---|---|
| 2,138,051 | 11/1938 | Williams | 241/1 X |
| 2,163,650 | 6/1939 | Weaver | 366/127 X |
| 3,339,896 | 9/1967 | McKibben | 366/111 |
| 3,904,392 | 9/1975 | Van Ingen et al. | 366/114 X |

FOREIGN PATENT DOCUMENTS

| | | | |
|---|---|---|---|
| 225122 | 2/1969 | Sweden . | |
| 1437286 | 5/1976 | United Kingdom . | |
| 369939 | 4/1973 | U.S.S.R. | 241/1 |

*Primary Examiner*—Philip R. Coe

*Attorney, Agent, or Firm*—Oblon, Fisher, Spivak, McClelland & Maier

[57] ABSTRACT

A process and an apparatus wherein the liquid to be homogenized or emulsified with the use of little energy relative to the amount of liquid is fed into an ultrasonic chamber (1) in which it is caused to flow as a thin layer across one or more ultrasonic generator surfaces (6), the liquid flow thus treated being admixed continuously with the remaining portion of the liquid within the chamber, finished homogenized/emulsified liquid being simultaneously carried past an ultrasonic generator surface (6) and discharged from the chamber (1).

6 Claims, 7 Drawing Figures

PROCESS FOR CONTINUOUS HOMOGENIZATION OR EMULSIFICATION OF LIQUID AND AN ULTRASONIC APPARATUS FOR CARRYING OUT THE PROCESS

TECHNICAL FIELD

The invention relates to a process and an ultrasonic apparatus for continuous homogenization or emulsification of liquids, whereby the liquid in an ultrasonic chamber is subjected to a kinematic, mechanical treatment and carried as a continuous flow past one or more ultrasonic generator surfaces.

BACKGROUND ART

Swedish patent specification No. 225,122 discloses an apparatus of the aforesaid kind, wherein the inflowing liquid is divided into split flows. These split flows are caused to pass a great number of small cavities and are accelerated towards a working slot where the processing is performed by cutting, crushing and interparticular grinding, the small particles being subsequently forced through a great number of sonic treatment chambers, wherein the particles in addition to the sonic treatment in the upstream are also subjected to sonic vibrations in the transverse direction. Such an apparatus is relatively complicated, requires much energy and is difficult to clean due to the small cavities, which is an essential drawback, especially when the apparatus is to be used for homogenization of milk or for treatment of other articles of food.

British patent specification No. 1,437,286 discloses an apparatus of a far simpler construction. In this apparatus the liquid, e.g. milk to be homogenized, is simply pumped through a T-tube past an ultrasonic generator surface. This apparatus is admittedly easy to clean, but even with the use of much energy for producing ultrasound and a small amount of passing liquid, it ensures no product of sufficiently good quality, that is, with practically perfect disintegration and uniform dispersion of the ingredients in the liquid mixture which is homogenized or emulsified. An effective ultrasonic treatment occurs only in the interface of the liquid passing the ultrasonic generator surface. At a slightly greater distance from this interface there is no appreciable emulsification and the ultra-sound has in itself no admixing or kneading effect and thus does not increase the grinding of e.g. the water drops in fuel oil. Since the amounts of liquids pumped past the ultrasonic generator surface at a slightly greater distance have no possibility of being returned and of contacting the surface, this known apparatus permits only of inadequate homogenization or emulsification and insufficient mixing to ensure a uniform dispersion of the ingredients in the liquid, even at a relatively high consumption of energy and with the use of a small amount of passing liquid.

DISCLOSURE OF INVENTION

By the invention is devised a process in which it is possible in a relatively small apparatus which is of simple and inexpensive design and easy to clean to treat effectively a large flow of liquid per unit of time at a low power consumption.

An essential feature of the process according to the invention is that an untreated liquid mix of several ingredients is fed continuously from one or more supply pipes directly into an ultrasonic chamber and is carried in a controlled flow pattern as a thin flowing layer across the ultrasonic generator surface or surfaces during continuous admixture of the thus treated flow of liquid in the remaining portion of the liquid within the chamber, homogenized/emulsified liquid being simultaneously discharged from the chamber after passing an ultrasonic generator surface.

The invention utilizes the circumstance that the ultrasonic homogenization occurs spontaneously on the ultrasonic generator surfaces proper since said surfaces have the highest ultrasonic intensity, whereby a heavy stirring of the liquid in the ultrasonic chamber produces a considerable change of liquid on the ultrasonic generator surfaces and thereby a rather considerable increase in the homogenization velocity at an available given ultrasonic energy. The mixing of the treated liquid flows with the remaining liquid provides not only a very uniform dispersion of the ingredients in the liquid, but involves furthermore an efficient grinding of the individual drops, thereby furthering the homogenization or emulsification process also in the portions of the liquid that are at a greater distance from the ultrasonic generator surface. By using relatively little energy, a heavy stirring may be obtained and thereby a fast treatment of the liquid, so that a great amount of passing liquid per time unit may be efficiently treated in a relatively small ultrasonic chamber. By causing the liquid flow to pass across one of the ultrasonic generator surfaces immediately before it leaves the ultrasonic chamber, it is ensured that the liquid leaving the chamber is always perfectly homogenized and that non-homogenized liquid continuously entering the ultrasonic chamber is not sucked out again before it has been homogenized.

An essential feature of the ultrasonic apparatus according to the invention is that the ultrasonic chamber comprises at least one mechanical stirrer such as a propeller, screw or lamella adapted and disposed in such a manner that it directs the liquid flowing into the chamber through one or more supply pipes across the ultrasonic generator surface or surfaces as a thin flowing layer during continuous admixture of the thus treated flow of liquid in the remaining portion of the ultrasonic chamber, and that one or more outlets open into the wall of the ultrasonic chamber in a plane or curved surface, said surface comprising substantially an ultrasonic generator surface which is located immediately before the outlet when seen in the direction of flow of the said thin flowing layer.

By means of the stirrer it is possible to produce a heavy stirring or kneading and a controlled flow of liquid layers along the ultrasonic generator surfaces, at a relatively low consumption of energy. As a result, an efficient homogenization or emulsification of a great amount of passing liquid per time unit may be obtained in an ultrasonic chamber of a small volume. Thus, tests have proved that a fuel oil amount of the order of 500 l/h can be emulsified in an ultrasonic chamber having a volume of ⅓rd 1 at an energy consumption as low as 120 to 150 W for producing ultra-sound and about 100 to 150 W for operating the stirrer.

An essential feature of one embodiment of the ultrasonic apparatus according to the invention is that the ultrasonic chamber is symmetrical with respect to rotation about a centre axis and any sectional figure appearing by intersecting the ultrasonic chamber and a plane comprising the centre axis is convex, i.e. the sectional figure never has a centre of radius of curvature lying outside the ultrasonic chamber.

The shape of the ultrasonic chamber has primarily for its object to make the stirring in the chamber as efficient as possible at the minimum possible consumption of energy and to cause all the liquid portions to contact the ultrasonic generator surfaces. By making the chamber of circular and convex shape, the advantage obtained is that none of the liquid portions can stand still within the ultrasonic chamber during the stirring.

BRIEF DESCRIPTION OF DRAWINGS

The invention will be further described below with reference to the accompanying drawings, in which.

BEST MODE FOR CARRYING OUT THE INVENTION

Figure 1:
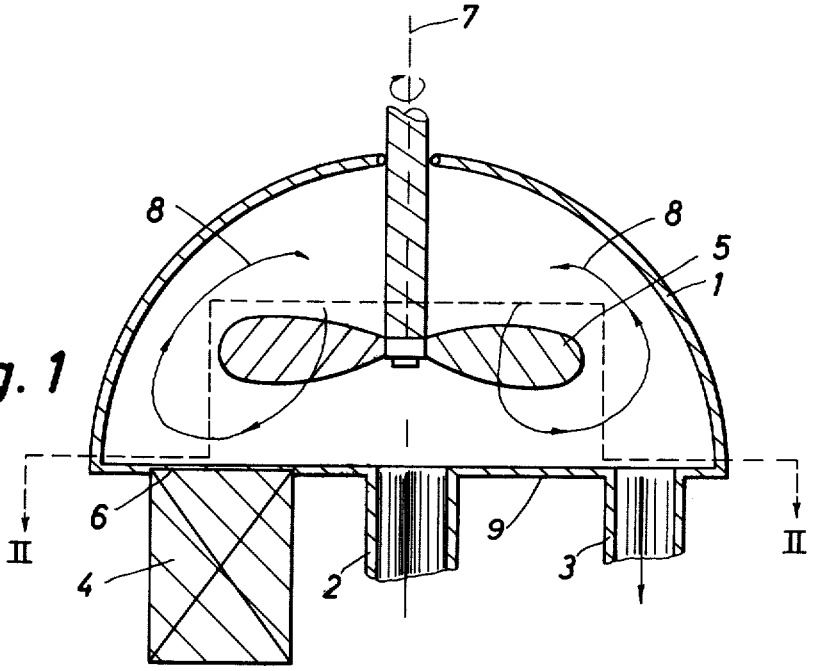
FIG. 1 is a vertical, sectional side view of an embodiment of the apparatus according to the invention.
Figure 2:
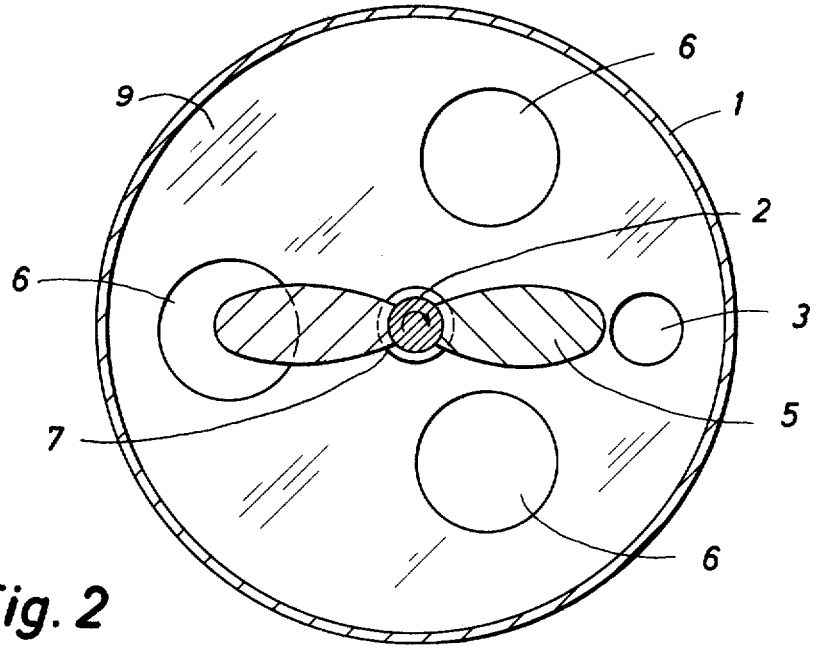
FIG. 2 is a top view taken along the line II-II of the embodiment of FIG. 1, and FIGS. 3 to 7 illustrate other embodiments of the apparatus according to the invention.

The ultrasonic chamber 1 is hemispherical, and the ultrasonic generators 4 are mounted in the plane end surface 9, whereby the ultrasonic generator surface 6 is in contact with the liquid within the ultrasonic chamber 1. The inner side of the ultrasonic chamber 1 is symmetrical with respect to rotation about the centre axis 7. Each section of the ultrasonic chamber, the plane of which comprises the centre axis 7, forms a convex figure, i.e. a figure never curving outwards away from the centre axis 7. The liquid to be ultrasonically treated within the ultrasonic chamber 1 is introduced through a supply pipe 2, the centre axis of which is aligned with the centre axis 7. The propeller 5, which is also coaxial with the centre axis 7, circulates the liquid downwards towards the ultrasonic generator surface 6 and upwards along the sides of the ultrasonic chamber 1 as indicated by the arrow 8. The heavy stirring and kneading of the liquid in the ultrasonic chamber 1 ensures a considerable change of liquid on the ultrasonic generator surface 6, which is a precondition for a high homogenization velocity. The homogenized liquid is carried away through an outlet 3 the opening cross section of which in the ultrasonic chamber is on the same level as the ultrasonic generator surfaces and which is mounted after one of the ultrasonic generator surfaces viewed in the direction of flow.

Figure 3:
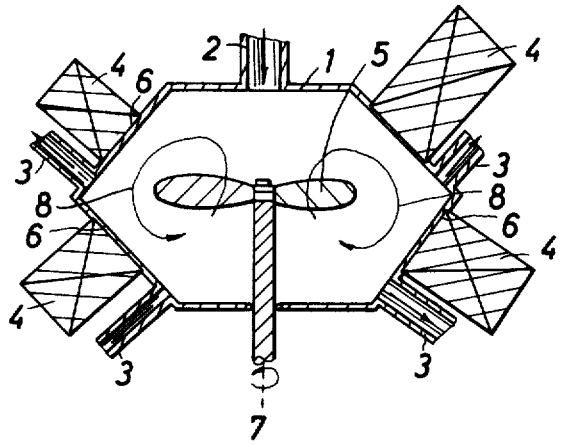
Figure 4:
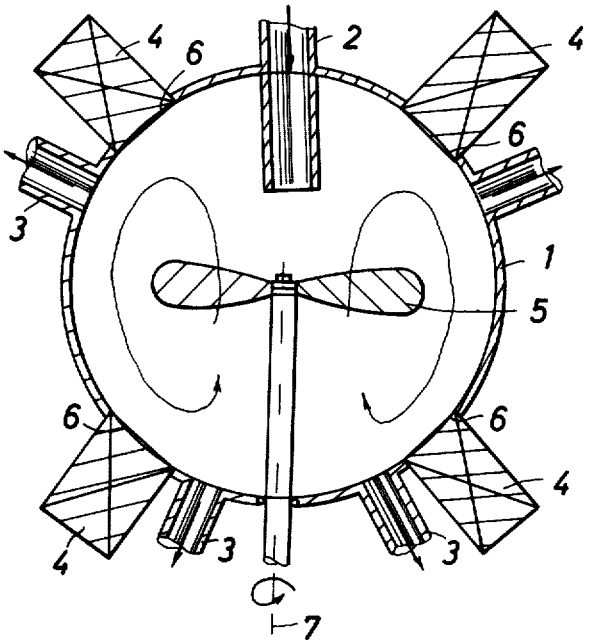
Figure 5:
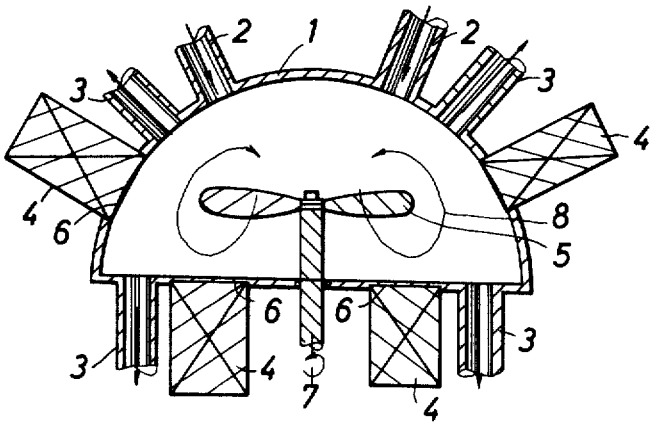

In general, the ultrasonic generators may be mounted anywhere on the ultrasonic chamber as shown in FIGS. 3–5, their location having no essential effect on the homogenization velocity.

The liquid to be homogenized need not necessarily be introduced into the central portion of the ultrasonic chamber, but may be introduced at several places of the chamber as well, also shown in FIGS. 3–5 provided no immediate mixing with the liquid discharged from the chamber can occur. The device for homogenization of liquid may also comprise several ultrasonic chambers arranged in parallel or in series.

The ultrasonic chamber may also comprise one or more mechanical stirrers.

Figure 6:
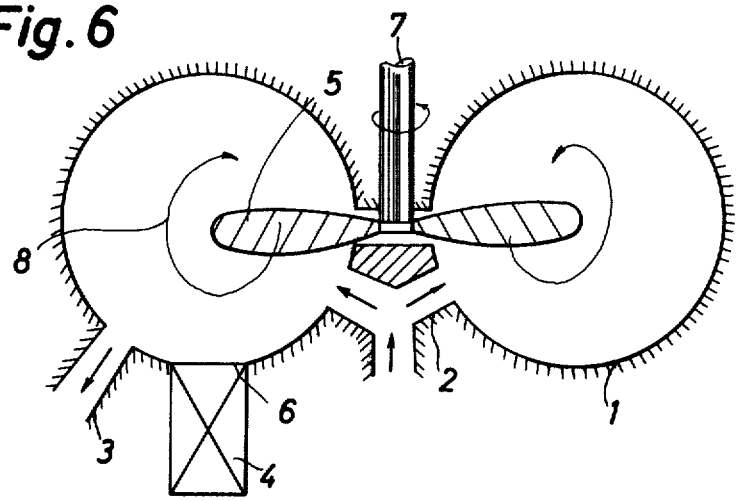

FIG. 6 is a vertical sectional view through a further embodiment using the same reference numerals for designating corresponding parts as in the abovementioned embodiments. In the illustrated torus ultrasonic chamber 1 heavy stirring is obtained in simple manner by means of the propeller 5 at a minimum consumption of energy and with maximum change of liquid over the ultrasonic generator surfaces 6.

Figure 7:
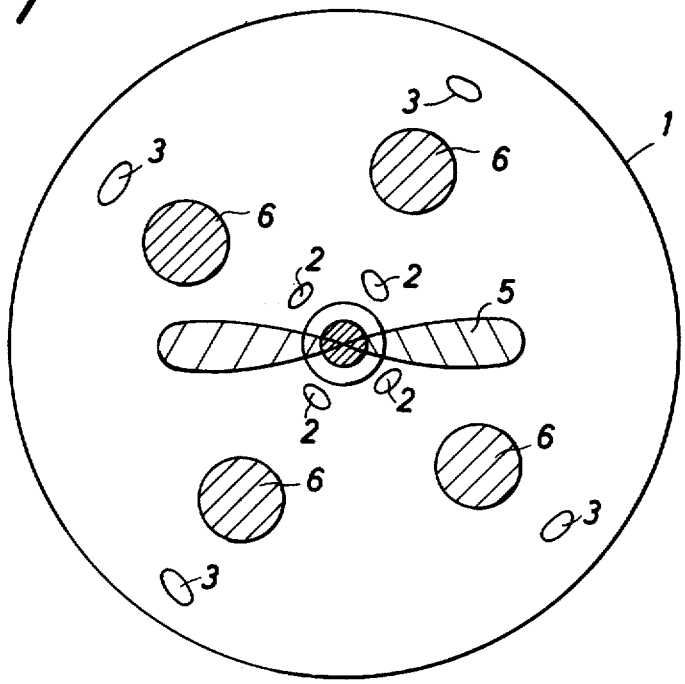

FIG. 7 is a horizontal sectional view through a further embodiment, in which supply pipes 2 are provided close to the centre axis and outlets 3 for discharging the liquid are located close to the periphery. The ultrasonic generator surfaces 6 are radially arranged inside the outlets 3.

What is claimed as new and desired to be secured by Letters Patent of the United States is:

1. An apparatus for continuous homogenization or emulsification of a liquid comprising:

a closed ultrasonic chamber having a wall and at least one inlet for said liquid and at least one outlet;

an ultrasonic generator having at least one ultrasonic generator surface opening into said wall of the ultrasonic chamber, said ultrasonic generator surface being disposed downstream from said at least one inlet and upstream from said at least one outlet;

means positioned in the ultrasonic chamber in communication with said inlet for stirring said liquid and directing a thin flowing layer of said liquid across said ultrasonic generator surface during continuous admixing of the thus treated liquid in the remaining portions of the ultrasonic chamber.

2. An apparatus as set for in claim 1, said wall comprising a planar wall.

3. An apparatus as set forth in claim 1, said wall comprising a curved surface wall.

4. An apparatus as set forth in claims 2 or 3, said chamber comprising a hemispherically shaped chamber.

5. An apparatus as set forth in claims 2 or 3, the ultrasonic chamber being symmetrical with respect to rotation about a center axis such that any sectional figure appearing by intersecting the ultrasonic chamber and a plane comprising the center axis is convex.

6. A process for continuous homogenization or emulsification of an untreated liquid comprising several ingredients in a chamber having an ultrasonic generator, which comprises the steps of:

supplying said liquid to be treated to said chamber;

exposing said liquid to ultrasonic vibrations from said ultrasonic generator within said chamber;

stirring and directing said liquid so as to form a thin flowing layer across a surface portion of said ultrasonic generator and be treated;

continuously admixing the treated liquid in the remaining portions of said chamber; and discharging said treated liquid from said chamber.

* * * * *